United States Patent [19]

Mansfield

[11] Patent Number: 4,656,808

[45] Date of Patent: Apr. 14, 1987

[54] ROOF SHINGLE LAYING MACHINE

[76] Inventor: Peter W. Mansfield, 511 59th St., Holmes Beach, Fla. 33510

[21] Appl. No.: 856,473

[22] Filed: Apr. 28, 1986

[51] Int. Cl.[4] ..... E04D 15/02

[52] U.S. Cl. ..... 52/749; 221/240

[58] Field of Search ..... 52/746, 748, 749, 750; 221/240; 156/92, 574, 579

[56] References Cited

U.S. PATENT DOCUMENTS 1,967,748 7/1934 Ehle ..... 156/574

3,245,192 4/1966 Hilson ..... 52/748

*Primary Examiner*—James L. Ridgill, Jr.

*Attorney, Agent, or Firm*—Charles J. Prescott

[57] ABSTRACT

A roof shingle laying machine having a drum mounted for rotation in a frame and adapted to be manually rolled transversly across a slooped roof for laying and securing shingles in row fashion atop the roof. The shingles are automatically placed in proper position for nailing or stapling as the machine is rolled across the roof and the operator positions shingles atop the drum. At the end of each row, this machine may be automatically laterally indexed on the roof, repositioned up the slope of the roof for laying the next adjacent row of shingles. This invention may also include staplers for automatically nailing the shingles in place, as well as a guide for assisting the user in properly directing and rolling the machine even when the roof has non-parallel eave and peak margins. A tray for supporting a stack of shingles and tensioned shingle retaining means for holding shingles against the drum prior to deposit on the roof are also provided.

14 Claims, 4 Drawing Figures

ROOF SHINGLE LAYING MACHINE

BACKGROUND OF THE INVENTION

This invention relates generally to roofing construction, and more particularly to an apparatus for installation of roofing shingles atop a slooped roof.

Asphalt roofing shingles must be layered in rows atop a slooped roof, starting with the lowest row along the eave of the roof and progressing upwardly toward the peak of the roof. This is so because each row of roofing shingles must overlap the row immediately below any given row to insure weather resistance. Additionally, each adjacent row is ordinarily displaced laterally a predetermined amount so that the ends and slots of each shingle do not coincide with those of the rows immediately adjacent thereto.

No known means of semi-automatic or automatic installation of the laying of shingles atop the roof is known to applicant. Each shingle must be manually placed by the installer in proper orientation prior to nailing or stapling that shingle in place.

The present invention provides a machine which is manually rollable across a slooped roof while depositing shingles in row fashion and in precisely the correct orientation one to another for stapling thereon. Indexing means is also provided to properly reposition the drum and frame upwardly at the end of each layered row of shingles so that the machine may be manually moved back across the roof to lay the next row of shingles, again in proper side-by-side orientation one to another and in proper alignment up the sloop of the roof one row to another.

BRIEF SUMMARY OF THE INVENTION

The present invention is directed to a roof shingle laying machine having a drum mounted for rotation in a frame and adapted to be manually rolled transversely across a slooped roof for laying and securing shingles in row fashion atop the roof. The shingles are automatically placed in proper position for nailing or stapling as manual displacement occurs. At the end of each row, this machine may be automatically laterally indexed up the slope of the roof, repositioned for laying the next adjacent row of shingles. This invention may also include staplers for automatically nailing the shingles in place, as well as a guide for assisting the user in properly directing and rolling the machine even when the roof has non-parallel eave and peak margins. A tray for supporting a stack of shingles and tensioned shingle retaining means for holding shingles against the drum prior to deposit on the roof are also provided.

It is therefore an object of this invention to provide a machine for conveniently and accurately disposing roofing shingles atop a slooped roof in ready positioning for stapling or nailing.

It is another object to provide the above invention with nailing means to permanently secure the properly positioned shingles.

It is yet another object to provide the above invention with nailing means which automatically triggers as the machine is manually rolled across the roof.

It is still another object to provide the above invention with automatic repositioning means for automatic realignment for each successive row of shingles layered.

And yet another object is to provide the above invention having visual guide means which automatically compensates for non-parallel eave and peak roof margins.

In accordance with these and other objects which will become apparent hereinafter, the instant invention will now be described with reference to the accompanying drawings in which:

DETAILED DESCRIPTION OF THE INVENTION

Figure 1:
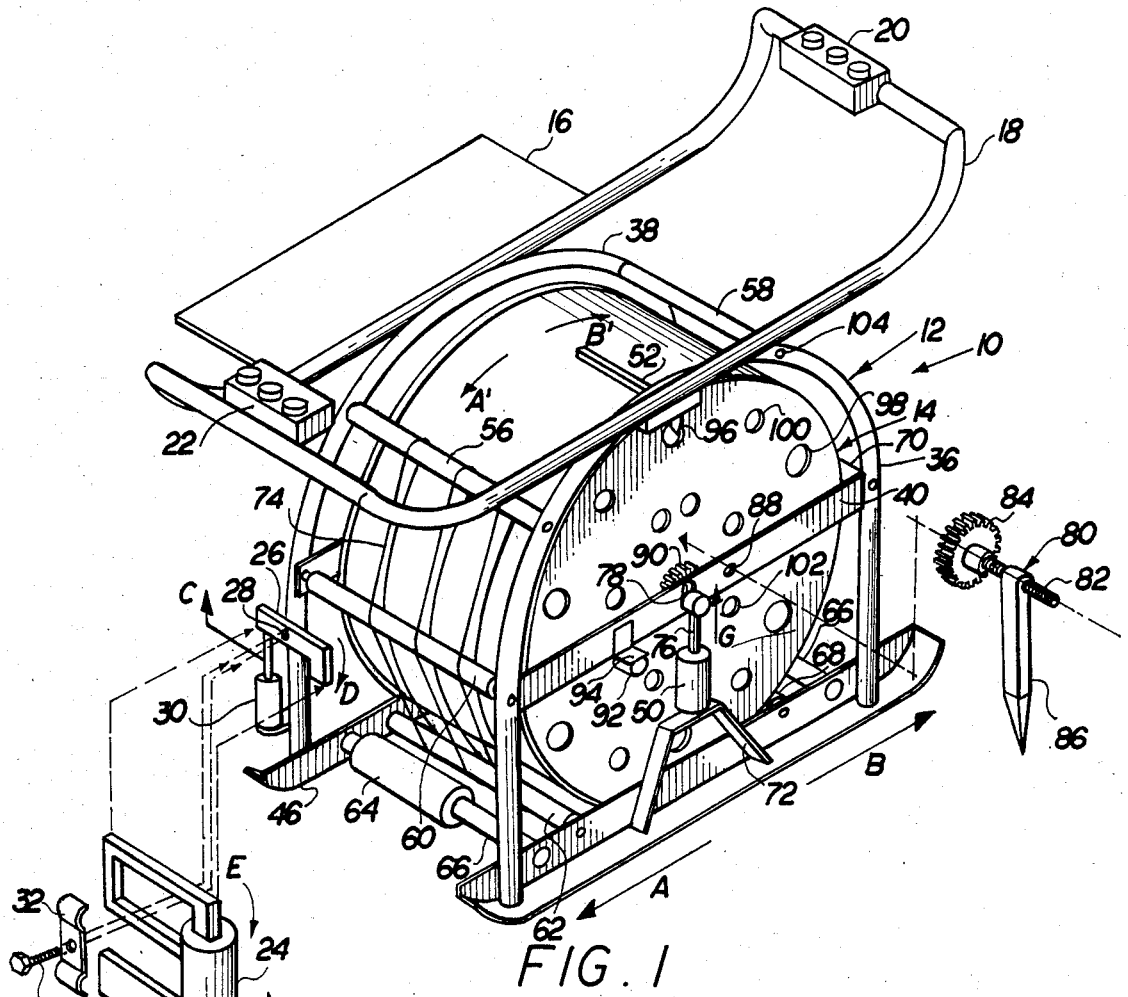
FIG. 1 is a perspective view of one embodiment of the invention.
Figure 2:
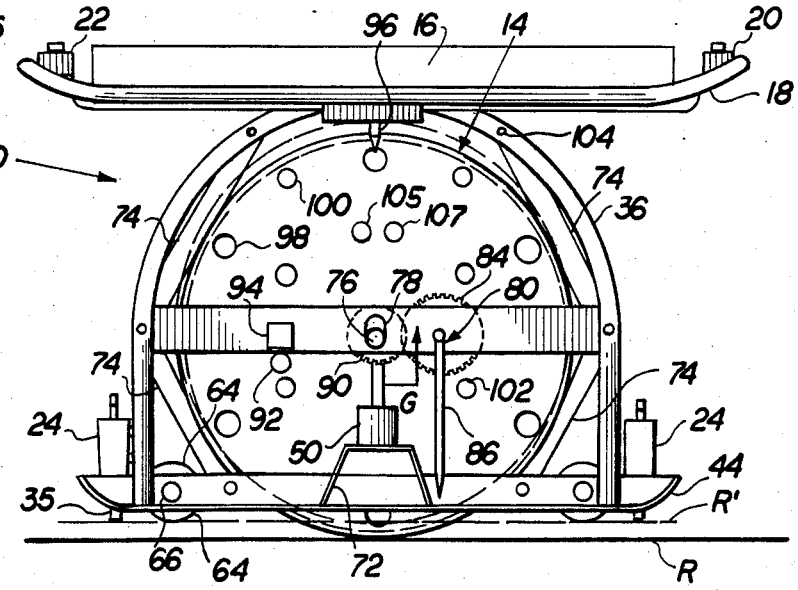
FIG. 2 is a side elevation view of the invention as shown in FIG. 1.

Referring now to the drawings, and particularly to FIGS. 1 and 2, the invention is shown generally at numeral 10 and includes a frame 12 and a drum 14 held for rotation within the frame 12 along axle 76. The frame 12 includes side portions 36 and 38 each having a generally inverted u-shape and securely spaced apart by rotatable crossbars 56, 58, 60, 62, 66 and 70. Skids 44 and 46 complete the bottom margin of each side portion 36 to 38. Handle 18 is connected between the tops of each side portion 36 and 38 and includes controls 20 and 22 thereon for convenient access. Tray 16 is disposed along one side of the handle 18 outwardly and upwardly therefrom for supporting a stack of shingles thereon.

Figure 3:
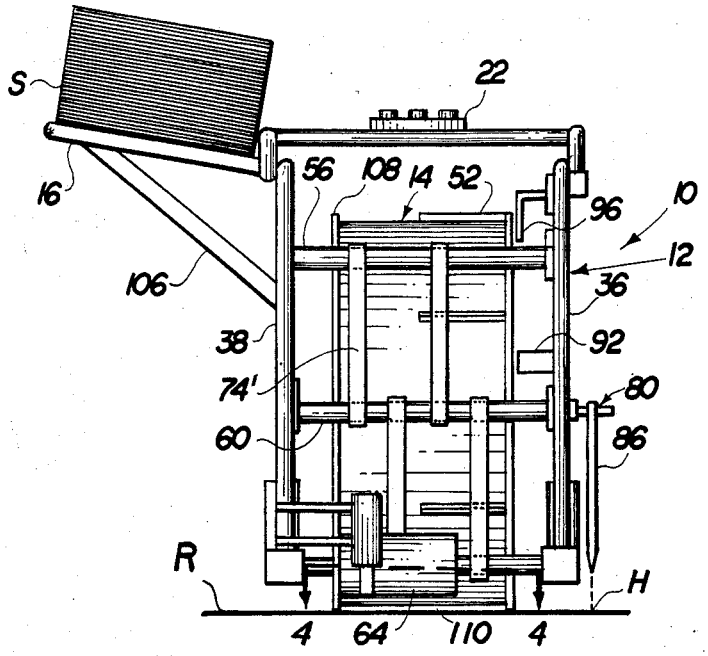
FIG. 3 is an end elevation view of an alternate embodiment of the invention.

Referring also to FIG. 3, the drum 14 includes edges 108 which create a circumferential recess 110 which is adapted to receive the typical width and thickness of an asphalt roof shingle. Shingle indexes 52 are connected to the drum 14 within recess 110 and are adapted to fit into the typical slot cut into the lower exposed margin of asphalt roof shingles. The overall circumference of the drum 14 is sized to substantially equal the length of preferrably two, and alternately, three, roof shingles, a dimension chosen merely based upon practicality of size. The opening to the top of the drum 14 between crossbars 56 and 58 is sufficient so that the operator may remove a roof shingle from stack S and place it upon the drum 14 into recess 110 and with slots fitted over indexes 52 accordingly.

Referring again to FIG. 1, the axle 76 of drum 14 is mounted into drum mounting bar 40, which is part of the frame 12. This arrangement allows the drum 14 to rotate freely in either direction A′ or B′. The axle 76 is mounted into slot 78 which is elongated to allow the axle 76 and drum 14 to move upward in the direction of arrow G. Drum lift actuator 50 mounted to bracket 72 on skids 44 and 46, one on each side, when properly energized, a ffect this movement of drum 14 in the direction of arrow G.

Also disposed between skids 44 and 46 are roller index actuators 64 mounted on shafts 66 and held thereon for lateral translation whose purpose and operation will be described herebelow. These roller index actuators 64 are adapted, as best seen in FIG. 2, such that, when drum 41 is lifted in the direction of arrow G in slot 78 by drum lift actuators 50, the contacting support for the entire machine 10 against roof R transfers from drum 14 to the roller index actuators 64, which is fabricated, preferably of hard rubber. This is shown in FIG. 2 symbolically along redrawn roof surface R'. The consequences of lifting drum 14 in this fashion is to eliminate all contact of the drum 14 with roof R, the usefulness of which will be described herebelow.

Figure 4:
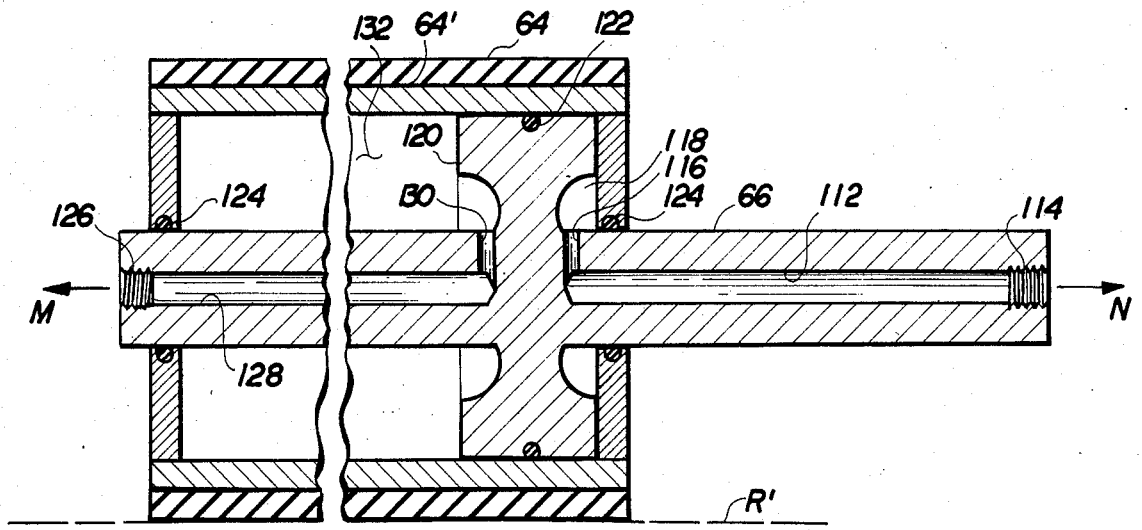
FIG. 4 is a section view in the direction of arrows 4—4 in FIG. 3.

Referring now to FIG. 4, the roller index actuator 64 is slideably mounted around shaft 66 as shown. Piston 120, integral with shaft 66, includes o-ring 122 to create, along with o-ring 124, a slideable seal on the interior of cylindrical tube 64'. When compressed air is forced through passageway 112 and aperture 116 into one side 118 of piston 120, because roller index actuator 64 is supported against the roof R', shaft 66 is forced in the direction of arrow M. O-ring 124 against shaft 66 maintains the pressurization during travel of the piston 120 and shaft 66 in that direction. Likewise, when compressed air is forced through passageway 128 and aperture 130 into the opposite side 132 of piston 120, shaft 66 is forced in the direction of arrow N and against the opposite end of roller index actuator 64.

By the above described controlled translation of shaft 66 in the direction of M or N within roller index actuator 64 when it rests upon the roof R', frame 12 and drum 14 move laterally up the slope of the roof R' a distance equal to the desired overlap spacing of each row of roofing shingles. This distance is the design amount established by the roof shingle manufacturers and is typically equal to one-third of the width of the standard shingles.

In sequence, then, at the end of each row of laid shingles wherein drum 14 rolls in the direction A' or B' and the entire machine 10 translates corresponding in direction A or B, drum lift actuators 50 lift the drum 14 upwardly in the direction of arrow G from contact with the roof R. At that point, when the entire weight of the shingle laying machine 10 is supported on roller index actuators 64, by applying compressed air into passageway 112 in FIG. 4, as previously described, shaft 66 is moved in the direction of arrow M, thus indexing the entire shingle laying machine 10 upwardly on the roof R the proper distance for laying the next row of shingles atop and partially overlapping that row previously laid. After this indexing of the shingle laying machine 10 is accomplished, drum lift actuator 50 is drawn to its shortest length such that the entire weight of the shingle laying machine 10 is now resupported on drum 14 and roller index actuators 64 are removed from roof contact. Finally, the roller index actuators 64 are oppositely activated by application of compressed air into passageway 128, thus moving shaft 66 back in the direction of arrow N, ready for the next indexing at the end of the next row of shingles laid in the opposite direction.

Referring again to FIG. 1, also connected to the frame 12 are staplers 24 which are connected to the side portions 36 and 38 by bracket 26 which is pivotedly mounted at 28. Bracket 26 will be pivoted in the direction of arrow D by energized actuator 30 moving in the direction of arrow C. When stapler 24 is bolted to bracket 26 by clip 32 and fastener 34, the stapler 24 will, likewise, rotate about pivot 28 in the direction of arrow E. The positioning of stapler 24 is adapted such that, when actuator 30 results in the rotation of the stapler 24 in the direction of arrow E, automatic foot trigger 35 will contact the roof shingle and depress foot trigger 35, causing the stapler 24 to discharge a stapler or nail into the roof shingle. A second stapler 24 is similarly opposingly mounted as shown in FIG. 2.

An important additional feature provided by the present invention 10 is the inclusion of means for laying alternate rows of shingles so that the slots in the lower edges of the exposed portion of the shingles are either intentionally aligned from row to row or intentionally misaligned between adjacent rows such that every other row of shingles has aligned slots in zig-zag fashion up the slope of the roof R. This second zig-zag arrangement is generally preferred and recommended by shingle manufacturers. To accomplish this alternate zig-zag row arrangement of slots in adjacent rows, drum 14 includes two arrangements of apertures 98 and 100 in one side of the drum 14 as best seen in FIG. 2 which are equally and alternately disposed in relation to one another and to index 96 such that, when larger aperture arrangement 98 has one of its set in registry with index 96, shingles which are properly disposed over shingle index bars 52 will have one set arrangement of shingle slots. However, on the next adjacent row, where the arrangement of smaller apertures 100 has one of its members initially aligned with index 96, and shingles are properly disposed on index bars 52, the shingles will be laid in non-aligned zig-zag fashion with the previously laid row of shingles.

Two arrangements of shingle retainers are shown for holding the shingles in place on the drum 14 until deposit on the roof. The first arrangement is shown in FIGS. 1 and 2 comprising continuous loops of elastomeric material 74 which are installed between crossbars 56 and 60, 60 and 62, 58 and 70, and 70 and 66 respectively as shown. These continuous loops forming the shingle retainers 74 then press along their inner length against the recess 110 in drum 14 and, as the entire shingle laying machine 10 is manually rolled along the roof R, disposing shingles thereon, the shingle retainers 74 hold each shingle against and within the drum recess 110 and in proper registry with index bars 52 until such time as the shingle begins to contact the roof surface. At that point, the shingle, by gravity, will disengage from the index bars 52 and out of recess 110 to be disposed atop the roof R in proper sequence and positioning in row fashion as previously described.

A second embodiment of the shingle retainers is shown generally at 74' in FIG. 3. This arrangement comprises continuous loops of belt material which are also installed under slight tension so that their inner lengths will again press against the recess 110 of drum 14 and shingles placed thereon by the operator.

In many situations, housing construction is less than perfectly accurate and roofs have somewhat non-parallel eave and peak margins. The net effect is that one side margin of the roof is longer than the other. If this non-parallel situation is substantial, unless the roof shingle rows are also properly arranged in small increments of divergence, the last row of shingles to be layered will be glaringly out of parallel with the roof peak or the previous row, or both, depending on the installers choice for rectifying a bad situation. Provided as an accessory to overcome this physical irregularity in roof sizing is guide 80 which includes gear 90 connected to the drum axle 76, gear 84 having threaded portion 82 extending along its axis, and pointer 86 which threadably engages over threaded portion 82 as shown. Gear 84 is held for rotation in aperture 88 such that gears 84 and 90 mesh one to another and such that threaded portion 82 rotates in response to drum rotation. Because of the weight of pointer 86, it does not rotate but instead, moves inwardly or outwardly depending on the rotational movement of gear 84 and threaded portion 82. As best seen in FIG. 3 then, pointer 86 provides visible indicia along line H projected to the roof R to assist the operator in manually guiding the shingle laying machine 10. The initial projected line H will be the eave margin of the roof R, next becoming each previously laid row of shingles.

In operation of guide 80 then, the operator first measures the overall length of the roof and, thus, each row of shingles to be laid and then measures the width at each side margin. This difference in width, in combination with the overall roof length and the calculated number of shingles may quickly be used to determine the divergence per row. From that determination, the proper gear 84 and feed of threaded portion 82 may be determined from a selection provided. By this means then, pointer 86 will track a precise projected line H for the operator's use in guiding the shingle laying machine 10 such that each row of shingles laid will be precisely equally divergent to minimize the viewable roof discrepancy.

Although the staple 24 may be triggered manually by the operator through the use of additional control means at 20 and 22, the present invention is provided with an automatic means for performing this operation. An inner circle of apertures is provided in the side of drum 14 at 102, 105, and 107. These apertures are in periodic registry with stapler sensor 92 mounted on bracket 94. The apertures 102, 105 and 107 are oriented in relation to the drum shingle indexes 52 such that a convenient and sufficient distribution of staples are inserted through each roofing shingle along its upper margin. The staple sensor 92 triggers the sequence of events as previously described leading to stapler 24 being rotated in the direction of arrow E and causing foot 35 to move in the direction of arrow F as its contacts the roofing shingle, firing the stapler 24.

While the instant invention has been shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

What is claimed is:

1. A roof shingle laying machine for laying shingles on a roof comprising:

a frame having a bottom;

a pair of roller index actuators mounted for lateral translation on cross shafts connected to said frame adjacent to said bottom of said frame;

a drum having an axle, said drum connected for rotation in said frame;

said drum also connected for limited movement relative to said frame between a lifted position and an unlifted position;

drum lifting means connected to said frame for moving said drum to said lifted position wherein said frame will be supported on said roller index actuators;

said drum having a circumferential surface with an upper portion of said surface open to receive a shingle, and a lower portion of said surface open to lay a shingle on the roof; and piston means connected to said cross shafts within said roller index actuators for moving said frame laterally relative to said roller index actuators when said drum is in said lifted position.

2. A roof shingle laying machine as set forth in claim 1, further comprising:

viewable guide means connected between said frame and said drum for indicating the proper drum path to be taken for each row of shingles atop the roof which has non-parallel eave and peak margins.

3. A roof shingle laying machine as set forth in claim 1, further comprising:

handle means connected to said frame for manually pushing said frame and said drum and for supporting control means for operating said first indexing means.

4. A roof shingle laying machine as set forth in claim 1, further comprising:

a tray connected to said frame for supporting a stack of shingles adjacent to said upper portion of said drum surface.

5. A roof shingle laying machine as set forth in claim 1, further comprising:

a plurality of circumferentially spaced shingle indexes on said drum surface.

6. A roof shingle laying machine as set forth in claim 1, further comprising:

shingle retaining means connected to said frame for preventing shingles from disengaging from said drum surface before the shingles reach said lower portion.

7. A roof shingle laying machine as set forth in claim 6, wherein said shingle retaining means includes:

a plurality of continuous loops of tensioned elastomeric material mounted between adjacent spaced cross members connected to said frame;

said loops positioned and adapted to press against the circumference of said drum.

8. A roof shingle laying machine as set forth in claim 6, wherein said shingle retaining means includes:

a plurality of continuous loops of tensioned flat belt mounted between adjacent spaced cross members connected to said frame;

said loops positioned and adapted to press against the circumference of said drum.

9. A roof shingle laying machine as set forth in claim 1, further comprising:

stapler means connected to said frame for stapling shingles atop the roof as shingles are laid on the roof.

10. A roof shingle laying machine as set forth in claim 1, further comprising:

automatic trigger means for timing the actuation of said stapler means.

11. A roof shingle laying machine as set forth in claim 10, wherein said automatic trigger means includes:

spaced stapler trigger apertures in one side of said drum radially disposed about the drum axis in periodic alignment and registry with a sensor connected to said frame;

said stapler trigger apertures and said sensor acting in a cooperative arrangement one to another to provide predetermined stapler means actuation signals as said drum rolls across the roof.

12. A roof shingle laying machine as set forth in claim 1, further comprising:

viewable drum positioning means for properly rotationally orienting said drum and said shingle receiving means at the beginning of each row of shingles.

13. A roof shingle laying machine as set forth in claim 12, wherein:

said drum positioning means also for placing alternate rows of shingles in non-alignment one to another such that the slots in the shingles are arranged in zig-zag fashion up the slope of the roof.

14. A roof shingle laying machine as set forth in claim 13, wherein said drum positioning means includes:

spaced drum positioning apertures in one side of said drum radially disposed about the drum axis in periodic alignment and registry with a drum positioning pointer connected to said frame;

said drum positioning apertures and said drum positioning pointer acting in a cooperative arrangement one to another to provide viewable indicia for proper orientation of said drum at the beginning of each row of shingles.

* * * * *